US005087144A

United States Patent [19]

Wada et al.

[11] Patent Number: 5,087,144

[45] Date of Patent: Feb. 11, 1992

[54] TEMPORARY INK STORAGE MEMBER AND WRITING INSTRUMENT USING THE SAME

[75] Inventors: Yoshihiro Wada, Yashio; Kazunori Suzuki, Kasukabe; Tadashi Kono; Katsuo Asano, both of Ishioka, all of Japan

[73] Assignee: Pentel Kabushiki Kaisha, Tokyo, Japan

[21] Appl. No.: 465,254

[22] PCT Filed: Jul. 27, 1989

[86] PCT No.: PCT/JP89/00767

§ 371 Date: Mar. 26, 1990

§ 102(e) Date: Mar. 26, 1990

[87] PCT Pub. No.: WO90/01423

PCT Pub. Date: Feb. 22, 1990

[30] Foreign Application Priority Data

Jul. 30, 1988 [JP] Japan ..... 63-101602[U]

[51] Int. Cl.[5] ..... B43K 8/04; B43K 7/08; B43K 5/18

[52] U.S. Cl. ..... 401/199; 401/227; 401/229

[58] Field of Search ..... 401/198, 199, 227, 229, 401/226, 225

[56] References Cited

U.S. PATENT DOCUMENTS

| | | | |
|---|---|---|---|
| 2,681,041 | 6/1954 | Zodtner et al. | 401/227 X |

FOREIGN PATENT DOCUMENTS

| | | | |
|---|---|---|---|
| 1461587 | 11/1969 | Fed. Rep. of Germany | 401/198 |
| 3538285 | 7/1986 | Fed. Rep. of Germany | 401/199 |
| 682471 | 2/1965 | Italy | 401/227 |
| 45-26344 | 10/1970 | Japan | 401/199 |
| 52-82434 | 6/1977 | Japan . | |
| 54-62428 | 5/1979 | Japan . | |
| 60-21260 | 6/1985 | Japan . | |
| 61-32790 | 9/1986 | Japan . | |
| 360925 | 4/1962 | Switzerland | 401/227 |
| 2169562 | 7/1986 | United Kingdom | 401/199 |

*Primary Examiner*—Steven A. Bratlie

*Attorney, Agent, or Firm*—Wenderoth, Lind & Ponack

[57] ABSTRACT

This invention relates to a temporary ink storage member for temporarily storing ink in accordance with pressure changes in an ink tank. The temporary ink storage member comprises a reduced thickness portion forming an ink storage portion and having a comb-toothed longitudinal sectional shape and slit-like ink grooves communicating with the ink storage portion, wherein a plurality of ink grooves are formed symmetrically with one another in cross-section. The present invention relates also to a writing instrument using the temporary ink storage member.

19 Claims, 7 Drawing Sheets

TEMPORARY INK STORAGE MEMBER AND WRITING INSTRUMENT USING THE SAME

BACKGROUND OF THE INVENTION

1. Field of the Invention

This invention relates to a temporary ink storage member for temporarily storing ink so as to suppress excess discharge and prevent insufficient discharge of ink due to changes in temperature and pressure when ink inside an ink tank is supplied to a pen tip. The invention further relates to a writing instrument having this temporary ink storage member inside a shaft body between a pen tip and an ink tank.

2. Description of the Prior Art

Writing instruments storing therein ink can be classified broadly into two kinds, depending on the mode of storage of ink. One kind utilizes an ink absorption member which functions to retain ink by utilizing the capillary force of, for example, a fiber aggregate, and the other kind merely stores ink in a container-like ink tank without relying in particular on the capillary force, as typified by an ordinary fountain pen.

As is well known, the latter generally uses a member for storing temporarily ink in order to prevent the occurrence of excess of insufficient ink supply from the ink tank to the pen tip due to changes in temperature and pressure.

Various contrivances have been made in the past in order to have the temporary ink storage member fully perform its functions.

Japanese Utility Model Publication No. 32790/1986, for example, discloses a device wherein the capillary force of each member forming the temporary ink storage member is different from other members forming the temporary ink storage member, wherein the members are arranged in a predetermined order so as to improve reliability of the ink storage function.

Besides the prior art reference described above various shapes and structures of temporary ink storage members are known, but most of them are made of a synthetic resin by injection molding. A large member of high quality writing instruments have been proposed, and put into practical application as products, due to various contrivances for the temporary ink storage member. However, they are not yet entirely satisfactory.

The greatest problem lies in that a temporary ink storage member capable of storing a large quantity of ink has not yet been invented. The capacity of the ink tanks of fountain pens that are now available on the market, for example, is about 1 cc and at most about 2 cc. However, a temporary ink storage member of a writing instrument capable of storing a large quantity of ink must itself be capable of storing a large quantity of ink.

The conditions that must be satisfied in order to let the temporary ink storage member fully perform its functions are listed below.

(1) The temporary ink storage member must be able to store a quantity of ink corresponding to an expansion quantity of air when air inside the ink tank expands, in order to prevent ink from flowing out.

(2) It must be able to preferentially return more ink, rather than air, to the ink tank when the volume of air inside the ink tank shrinks. If air enters the ink tank while ink temporarily remains in the ink storage member, the quantity of ink that is left inside the temporary ink storage member increases gradually over repeated cycles of volume changes of the air in the ink tank, until it reaches a point where the temporary ink storage member will no longer function.

(3) If the temporary ink storage member stores ink when ink is consumed by the pen tip during writing, the temporary ink storage member must be able to preferentially supply this stored ink to the pen tip rather than the ink inside the ink tank, or must be able to preferentially return this stored ink to the ink tank rather than air, in order to prevent the drop of the pressure of the ink tank due to consumption of ink from the ink tank by the pen tip. This is due to the same reason as the condition (2) described above.

(4) The temporary ink storage member must have a high capillary force portion. Since an ink tank opening other than the pen tip is formed, ink will flow more than necessary and result in leakage of ink, unless the capillary force is sufficiently high.

(5) The capillary force of the condition (4) must not be excessively high. If it is higher than that on the pen tip side, the movement of ink due to the change of the internal pressure of the ink tank will occur on the pen tip side. In addition, when ink is consumed by the pen tip during writing, ink staying in the temporary ink storage member then returns to the ink tank and the air enters the ink tank and must rupture the film of ink. However, a certain level of force is necessary to rupture this ink film and if this force is too strong, the pressure in the ink tank will drop and, eventually, the supply of ink to the pen tip will become insufficient. Besides these various conditions described above, the following practical condition (6) must be satisfied.

(6) The temporary ink storage member must have a large bulk capacity. If the bulk capacity is great, the quantity of ink that can be stored in the ink tank must be reduced as much, or the size of the writing instrument must be increased.

To satisfy all the conditions described above, extremely complicated and precision molded articles must be produced. The thickness of the portion forming the ink storage portion, for example, is ordinarily below 1 mm. Moreover, the ink storage portion for retaining ink by the capillary force is molded with a width of 0.2 or 0.3 mm. The number of such molded articles may be small if it is small as a whole but molding becomes more difficult with increasing size. For example, in the apparatus disclosed in the above-mentioned prior art publication, it is extremely difficult to obtain a practical molded article, and dimensional variance resulting from molding must also be taken into consideration. Even if the problems of molding, which become greater if the ink storage portion has a greater size, are solved, it becomes more difficult to fundamentally satisfy the conditions (2) and (3) described above, because the distance over which ink must move becomes greater.

SUMMARY OF THE INVENTION

It is a main object of the present invention to provide a novel ink storage member solving the problems of the prior art technique described above, and a writing instrument using such an ink storage member.

It is another object of the present invention to provide a temporary ink storage member which can store a large quantity of ink.

It is still another object of the present invention to provide a writing instrument in which the temporary ink storage member can properly function.

It is still another object of the present invention to provide an ink storage member and a writing instrument using the ink storage member that can be produced relative easily.

The present invention is embodied as:

(1) A temporary ink storage member for temporarily storing ink in accordance with pressure changes in an ink tank, comprising a reduced thickness portion forming an ink storage portion and having a comb-toothed longitudinal sectional shape, and slit-like ink grooves communicating with the ink storage portion, a plurality of the ink grooves being formed in such a manner as to be symmetric with one another in cross-section.

(2) A temporary ink storage member for temporarily storing ink in accordance with pressure changes in an ink tank, comprising a reduced thickness portion forming an ink storage portion and having a comb-toothed longitudinal sectional shape, slit-like ink grooves communicating with the ink storage portion, and air exchange grooves, the ink storage member having a somewhat flattened cross-sectional shape wherein the air exchange grooves are formed at side portions of the flat cross-section.

(3) A temporary ink storage member, made of a synthetic resin molded by injection molding by use of split molds, for temporarily storing ink in accordance with a pressure change in an ink tank, comprising a reduced thickness portion forming an ink storage portion and having a comb-toothed longitudinal sectional shape, slit-like ink grooves communicating with the ink storage portion, and air exchange grooves, the ink grooves being formed by at least one of two or more split molds and the air exchange grooves being formed by a core pin disposed between the split molds.

(4) A writing instrument having inside a shaft body thereof a temporary ink storage member for temporarily storing ink in accordance with pressure changes in an ink tank, characterized in that the ink storage member has a somewhat flattened cross-sectional shape and is interposed between a pen tip side and an ink tank side inside a shaft body, wherein the shaft body has at least a front member and the ink tank are assembled in advance as a unitary assembly.

BRIEF DESCRIPTION OF DRAWINGS

FIGS. 7 to 27 show respective components of FIG. 6, wherein:

FIG. 7 is a partially cut-away longitudinal sectional view of a crown;

FIG. 8 is a partially cut-away longitudinal sectional view when the crown shown in FIG. 7 is rotated by 90°;

FIG. 9 is a front view of the crown of FIG. 7;

FIG. 10 is a bottom view of the crown of FIG. 7;

FIG. 11 is a partially cut-away longitudinal sectional view of a cap;

FIG. 12 is a front view of the cap shown in FIG. 11;

FIG. 13 is a bottom view of the cap of FIG. 11;

FIG. 14 is a partially cut-away longitudinal sectional view of a front shaft;

FIG. 15 is a front view of the front shaft of FIG. 14;

FIG. 16 is a bottom view of the front shaft of FIG. 14;

FIG. 17 is a side view of a pen tip;

FIG. 18 is a side view of the temporary ink storage member;

FIG. 19 is a partially cut-away longitudinal sectional view when the temporary ink storage member of FIG. 18 is rotated by 90°;

FIG. 20 is a partially cut-away longitudinal sectional view of an ink tank;

FIG. 21 is a partially cut-away longitudinal sectional view of the ink tank of FIG. 20 when it is rotated by 90°;

FIG. 22 is a front view of the ink tank of FIG. 21;

FIG. 23 is a partially cut-away longitudinal sectional view of a rear shaft;

FIG. 24 is a partially cut-away longitudinal sectional view of the rear shaft in FIG. 23 when it is rotated by 90°;

FIG. 25 is a front view of the rear shaft of FIG. 23;

FIG. 26 is a bottom view of the rear shaft of FIG. 23; and

FIG. 27 is a transverse sectional view taken along line XXVII—XXVII of FIG. 23.

DETAILED DESCRIPTION OF THE INVENTION

First of all, in FIGS. 1 to 4 showing an example of a temporary ink storage member (hereinafter referred to merely as the "ink storage member"), the ink storage member 1 includes a through-hole 1*a* formed in a core portion thereof, a reduced thickness portion 1*b*, an ink groove 1*c* and a communication portion 1*d*.

Figure 1:
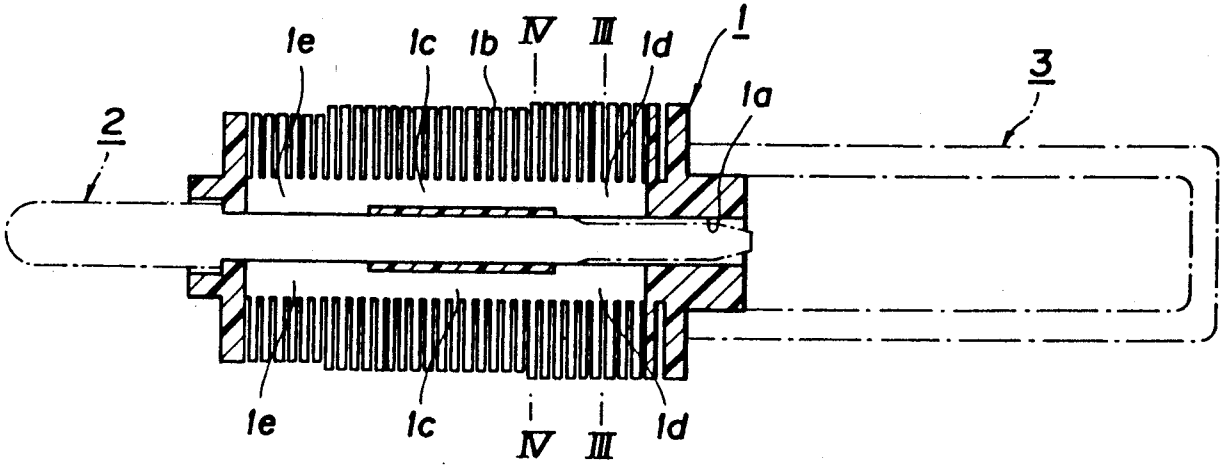
FIG. 1 is a longitudinal sectional view showing an embodiment of a temporary ink storage member in accordance with the present invention.

An ink relay member, which comprises a suitably formed fiber aggregate member or ink passage and is connected to a rear part, or at the back, of a writing nib such as a pen tip 2, is fitted into the through-hole 1*a*. In other words, the through-hole 1*a* functions as an original ink passage for writing which communicates between an ink tank side and a pen tip side. Incidentally, FIG. 1 shows the state in which the rear part of the pen tip 2 is inserted and the ink tank 3 is fitted.

The reduced thickness portion 1*b* is for forming the ink storage portion and the gaps between the elements of the reduced thickness portion define the portion for temporarily storing ink. This reduced thickness portion 1*b* has a comb-toothed shape in its longitudinal section, and is shaped as a plurality of thin wall portions juxtaposed with one another or as a spiral reduced thickness portion as disclosed in the prior art reference described previously.

The ink groove 1*c* is slit-like, and is shaped in this embodiment in such a manner as to extend up to the outermost end of the reduced thickness portion. It is not desirable, however, to make the capillary force of this ink storage portion stronger than that of the ink groove 1*c*.

The communication portion 1*d* is molded in this embodiment as an opening to the through-hole 1*a* of the ink groove 1c, because this makes the molding procedure easy. However, it need not always be formed as part in the ink groove 1c because its function is to guide ink from the ink tank 3 into the ink groove 1c, and it may be connected to the ink tank 3 separately from the through-hole 1a.

As shown in the drawings, two ink grooves 1c are formed in such a manner as to be symmetric with each other in cross-section, and this is very important as will be explained below.

Ink that enters the ink storage member 1 from the ink tank 3 flows to both the pen tip and to the communication portion 1d. Since the communication portion 1d is formed as part of the ink groove 1c in this embodiment, ink also flows to the ink groove. In the interim, if ink only flows out from the ink tank 3, the internal pressure of the ink tank 3 drops. In practice, air enters the ink tank 3 through the communication portion 1d. When the external pressure is substantially equal to the internal pressure of the ink tank 3, an ink film, which cuts off the interior of the ink tank 3 from the outside, is formed at the communication portion 1d. No ink stays in the ink storage portion under such condition, but if the air inside the ink tank 3 expands due to the body temperature of a hand, for example, ink is expelled. As described above, since the capillary force on the pen tip side is greater, this expelled ink is forced into and stays in the ink storage portion through the communication portion 1d and the ink groove 1c. When the volume of air inside the ink tank 3 shrinks, on the contrary, ink in the ink storage portion returns to the ink tank 3 through the ink groove 1c and the communication portion 1d. Expulsion from and return of ink to the ink tank 3 are effected through the two ink grooves 1c. In other words, when ink returns to the ink tank, it returns to near the respective ink groove 1c and when a large quantity of ink returns, it returns in a ring-like form. Moreover, when ink returns, it returns from the two ink grooves 1c that are symmetric in the cross-section. Accordingly, the distance to one of the ink grooves 1c is small, at most 90°. For this reason, the occurrence of ink left in the ink storage portion is reduced. Here, the two ink grooves 1c are preferably designed to have the same shape and the same size, but the dimensional error generally occurs due to variance of molding. This dimensional error results in a large difference in the movement of air subsequent to the movement of ink, though it does not cause much difference in the movement of ink. In other words, when the ink is fully returned to the ink tank 3 through one of the ink grooves 1c having the smaller capillary force, the ink film is formed at least the communication portion 1d of that ink groove 1c. After this ink film is formed, the force of the air necessary to break the ink film is relatively large as already described, and the return of ink from the other ink groove 1c continues. Intrusion of the air that breaks the ink film starts only after the ink films are formed in both the ink grooves. Accordingly, intrusion of the air occurs mostly at the communication portion 1d of the ink groove 1c which has the relatively smaller capillary force. If ink that is to move to the ink groove 1c where the film is formed remains in the ink storage portion, the time from the formation of one of the ink films to the formation of the other provides a time margin for ink to move to that ink groove 1c. Accordingly, when the two ink grooves 1c are shaped symmetrically relative to one another in cross-section, excellent results are achieved, even if there actually exists a variance in the molding.

Figure 2:
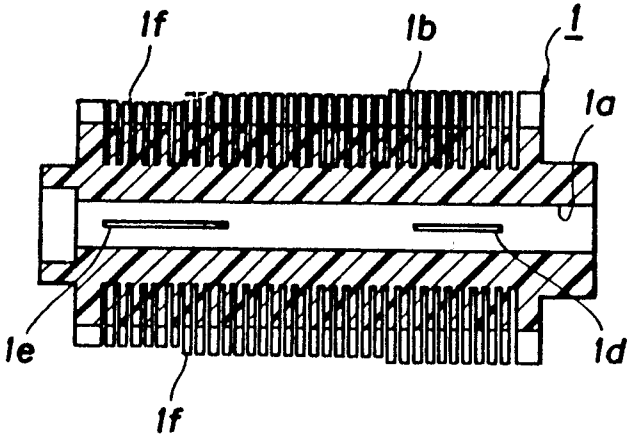
FIG. 2 is a longitudinal sectional view when the temporary ink storage member shown in FIG. 1 is rotated by 90°.

Incidentally, the opening represented by reference numeral 1e in both FIGS. 1 and 2 is formed on the basis of the concept that ink staying in the ink storage portion can be positively consumed by the pen tip, but no gap is defined between the pen tip 2 and the through-hole 1a in FIG. 1 lest the air enter the through-hole 1a through this opening 1e. Therefore, the opening 1e itself need not exist in order to fulfill the afore-mentioned condition (3) if it would cause the problem of allowing the intrusion of air.

Figure 3:
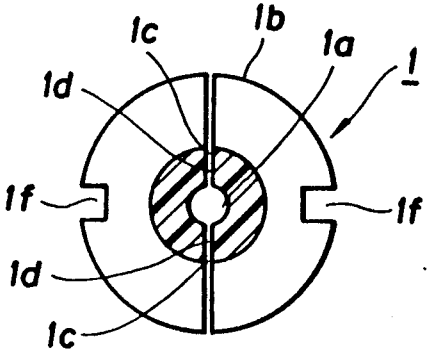
FIG. 3 is a transverse sectional view taken along line III—III in FIG. 1.
Figure 4:
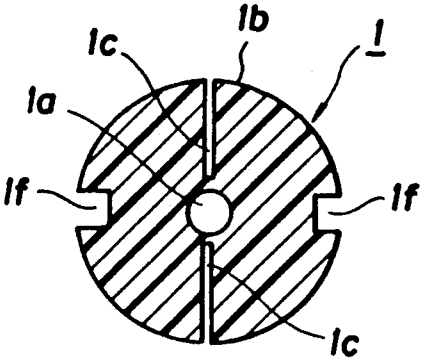
FIG. 4 is a transverse sectional view taken along line IV—IV of FIG. 1.

The portions represented by reference numeral 1f in FIGS. 2 to 4 are air exchange grooves and are formed as recesses extending in the longitudinal direction of the ink storage member 1. Though these air exchange grooves 1f are not essential, there are situations in which it is preferable to provide such air exchange grooves 1f as part of the shape of the ink storage member itself. This will be explained with reference to the next embodiment.

Figure 5:
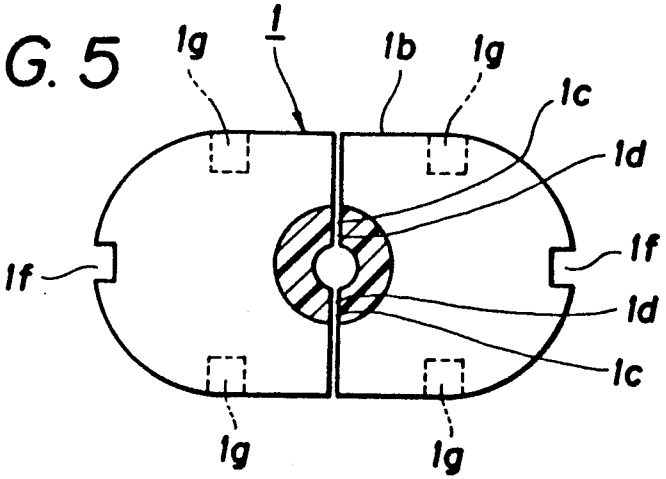
FIG. 5 is a transverse sectional view showing another embodiment of the temporary ink storage member and corresponding to FIG. 3.

FIG. 5 is a transverse sectional view corresponding to FIG. 3 and shows a modified example of the ink storage member. The ink storage member 1 of this embodiment has a substantially elliptic cross-sectional shape. In order to store a greater quantity of ink, the ink storage member 1 may have a cross-sectional shape having a flat portion such as a diamond shape, a rectangular shape or shapes analogous to the former, in order to provide a desired appearance and also increase the diameter. This embodiment represents one example of such shapes.

When the ink storage portion has a cross-sectional shape having a flat portion, ink existing at the side portions of the cross-section (the right and left end portions in FIG. 5 is difficult to move. It is necessary to promote movement of such ink in order to allow the ink storage member to properly perform its functions. Therefore, the air exchange grooves 1f are disposed at such side portions in this embodiment. These air exchange grooves 1f promote the movement of ink.

The formation of the air exchange groove 1f at each side portion of the flat cross-section provides a desirable result whether or not the ink groove 1c is formed symmetrically with respect to the cross-section, as in the foregoing embodiment. In other words, the desired result can be obtained even when only one ink groove 1c is provided. However, the embodiment shown in FIG. 5 has two ink grooves 1c in the same way as the foregoing embodiment. This is based on the concept that a more preferable result can be obtained by combining this embodiment with the concept of the foregoing embodiment. Incidentally, other recessed portions can be formed at portions other than the side portions of the flat cross-section of the ink storage member 1 during the molding process. The recess 1g represented by a dotted line in FIG. 5 illustrates an example of such recessed portions.

Next, the molding process will be discussed. When the ink storage portion is obtained by injection molding of a synthetic resin, it may be quite natural to use split molds. In this case it is possible to let the split molds correspond to both the ink groove 1c and the air exchange groove 1f when both of them are molded. In other words, shapes corresponding to the ink groove 1c and the air exchange groove 1f can be provided in the split molds. However, such an arrangement is not preferable for split molds which assume a generally complicated shape even without such ink groove and air exchange groove. In practice, the complicated shape of the ink storage member often makes it difficult to release the molded article from one of the split molds. This difficulty often results in the deformation of a core pin forming the through-hole 1*a* (the through-hole 1*a* is molded for utilization as the ink passage from the ink tank to the pen tip and from a different aspect, it defines the arrangement position of the core pin).

To ensure easy moldability, therefore, at least one of the ink grooves 1*c* and the air exchange grooves 1*f* are formed by the core pin separately from the split molds. Here, the ink grooves 1*c* need not always extend to the outermost end portion of the reduced thickness portion 1*b*, so long as they are at least formed at portion from which the reduced thickness portion 1*b* projects, as to communicate with the ink storage portion defined between the members of the reduced thickness portion 1*b*. In addition, the ink groove 1*c* need not always be linear, but may be zigzag. Accordingly, it may be formed by the core pen. However, the ink groove 1*c* cannot be formed by a thick portion from the aspect of shape. It will be conceivable from this to form the air exchange groove 1*f* by the core pin, because it can be molded by a thick portion. In this case, it is also preferable to form air exchange grooves 1*f* at the side portions of the flat cross-section as shown in FIG. 5, to enhance moldability. A shallower split mold will make it easier to release the molded articles when a product having a flat cross-section is to be obtained. In other words, when an ink storage member having a greater ink storage capacity is formed, a flat cross-section is more advantageous from the aspect of moldability.

From the aspect of the preparation of molds, the number of split molds is preferably as small as possible. If the description is made on the assumption that the number of split molds is two, withdrawal of the molded article is easier when the moving direction is in the vertical direction in FIG. 5 than when it is in the transverse direction, if the product shown in FIG. 5 is to be obtained. If the air exchange groove 1*f* is molded by the core pin in FIG. 5, the air exchange groove 1*f* is formed at the flash line or in other words, at the portion for which it is most difficult to provide dimensional control during molding. Namely, the air exchange groove 1*f* is formed at the portion which reinforces the core pin for forming the through-hole 1*a* and, moreover, at which control of the ink movement is likely to be insufficient due to the dimensional variance of the ink groove 1*c*. If the ink groove 1*c* is disposed by rotating it by 90° relative to the air exchange groove 1*f* as shown in FIG. 5, it means that the ink groove 1*c* is molded by the split mold.

Next, an embodiment of a writing instrument using an ink storage member having a large ink storage capacity will be described with reference to FIGS. 6 to 27.

The large ink storage capacity provides the advantage that the writing instrument can be used for an extended period of time due to the ability to store a large quantity of ink, in not only the case of an ordinary fountain pen of the type wherein the ink tank is replaced by a new one when ink inside it is fully consumed, but also in the case of a throw-away writing instrument which is thrown away when the ink is fully consumed.

Since the throw-away writing instrument is fundamentally low-priced, variations can be made to the shape of each component, the assembly method, and the like, in order to attain the low price. Therefore, though the following description will be given by taking the throw-away writing instrument into consideration, the present invention can of course be applied to the writing instruments of the ink tank exchange type.

Since, when considering moldability, it is preferable that the ink storage member has a flat cross-section, the ink storage member shown in the drawing has such a shape, but the following description can be applied irrespective of the shape of the ink storage member.

Figure 6:
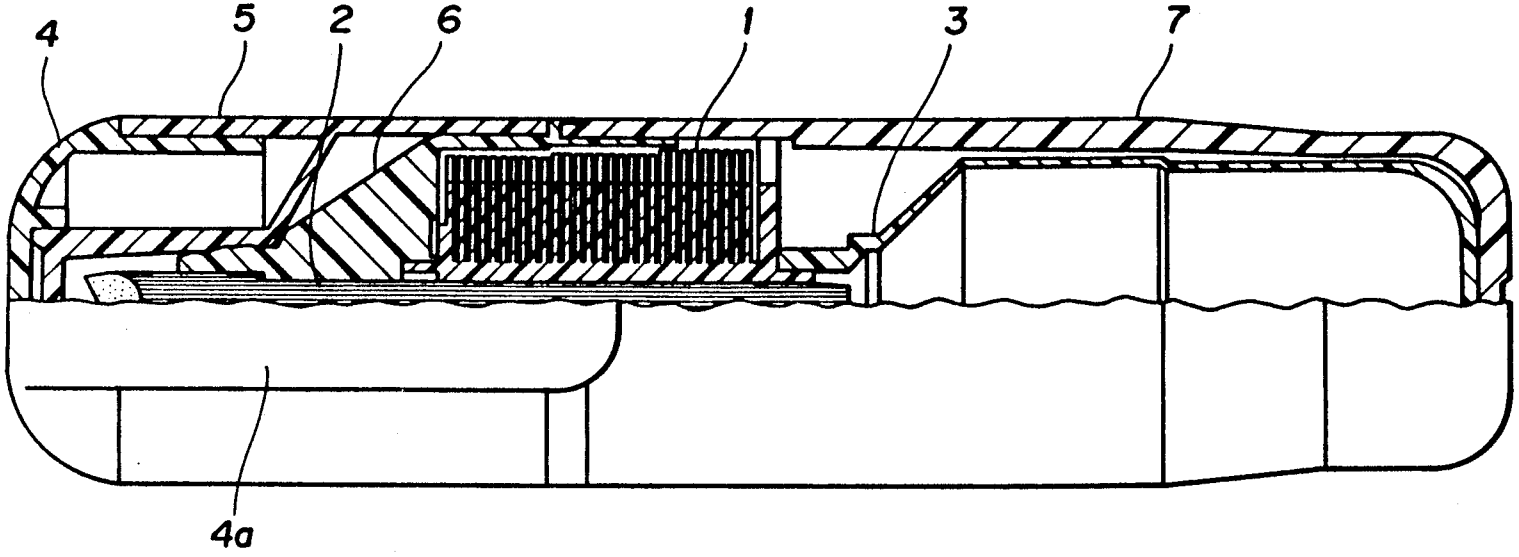
FIG. 6 is a partially cut-away longitudinal sectional view showing an embodiment of a writing instrument in accordance with the present invention.
Figure 7:
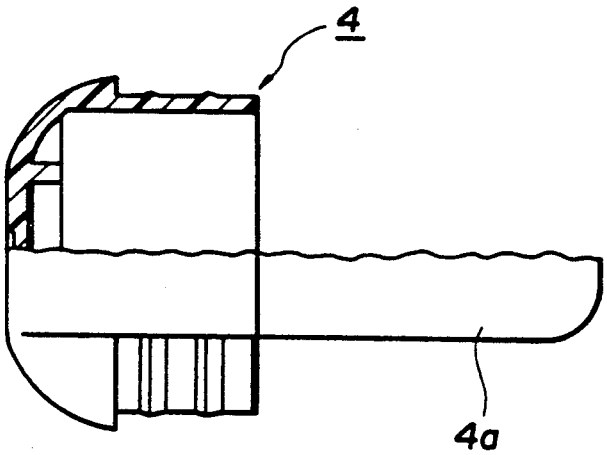
Figure 9:
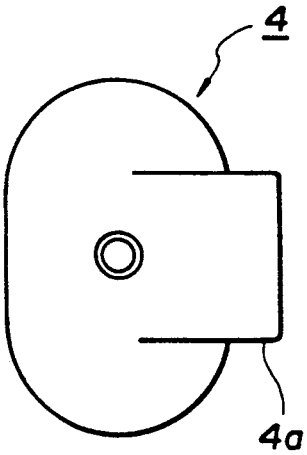
Figure 8:
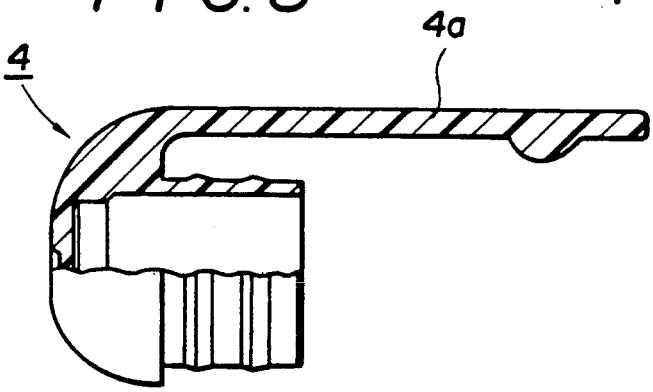
Figure 10:
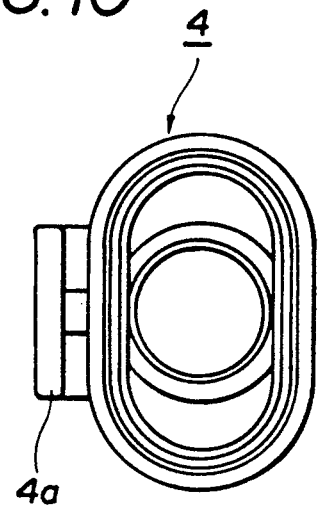

FIG. 6 shows the assembled state. The side portions of the flat cross-section are in the vertical direction in the drawing. A crown 4 has a clip 4*a* molded integrally therewith as shown in FIGS. 7 to 10 and can be obtained easily and economically by injection molding of polyethylene, polypropylene, nylon, polyacetal, acrylonitrile-butadiene, styrene, and other synthetic resins. The crown 4 is pressed into, and fixed to, a cap 5.

Figure 11:
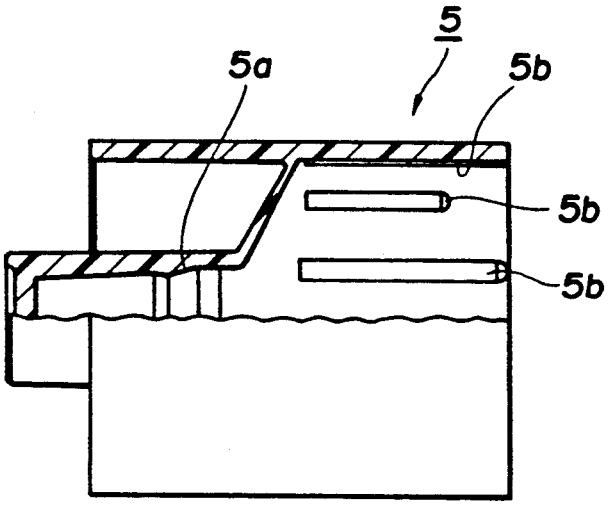
Figure 12:
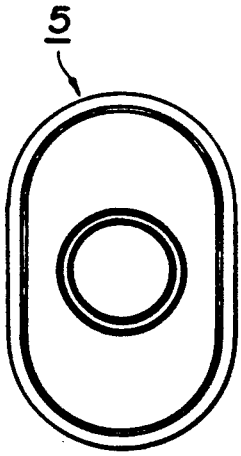
Figure 13:
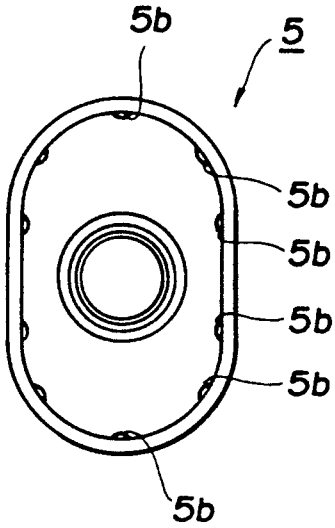

As shown in FIGS. 11 to 13, the cap 5 has a seal portion 5*a* for preventing drying of the pen tip 3 and a projection 5*b* for pressing into a front shaft 6 when the cap 5 is received on the front shaft 6. Though the drawings show only two pressing projections 5*b* formed at the side portions of the flat cross-section and another eight projections (i.e. 10 projections in total), the number of projections may be varied as appropriate. In this case, if the projections at the side portions of the flat cross-section are substantially longer than others or are otherwise of different lengths, their fitting into the front shaft 6 can be made smooth. The cap 5 can also be molded easily and economically by injection molding of a synthetic resin.

Figure 14:
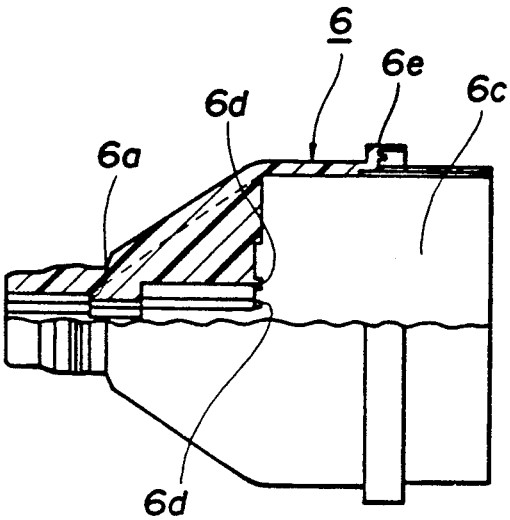
Figure 15:
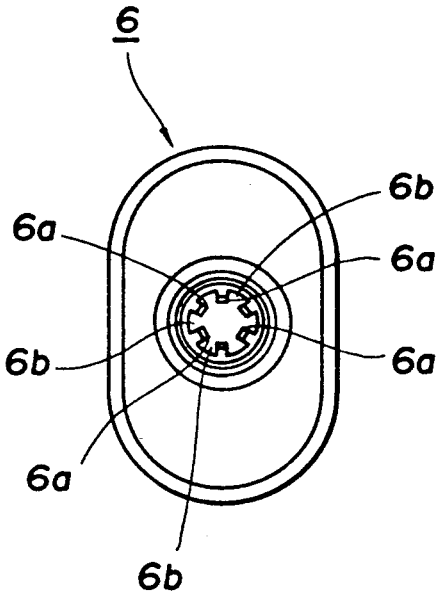
Figure 16:
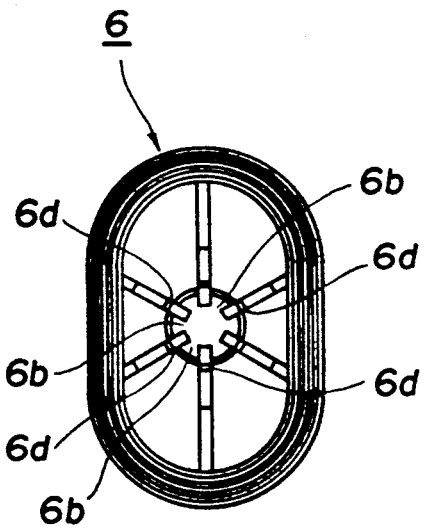

As shown in FIGS. 14 to 16, the front shaft 6 has a plurality of engagement step portions 6*a* for projecting and fixing the pen tip, a plurality of recessed portions 6*b* as a communication passage for internal and external air, an inner hole 6*c* and a plurality of small projections 6*d* for striking the ink storage member 1 and limiting its advance within the small hole 6*c*. The front shaft 6 also includes a flange 6*e* on its outer wall surface. This front shaft 6 can also be easily molded by injection molding of a synthetic resin. The communication passage for the internal and external air described above may be formed on a suitable member in a suitable shape.

Figure 17:
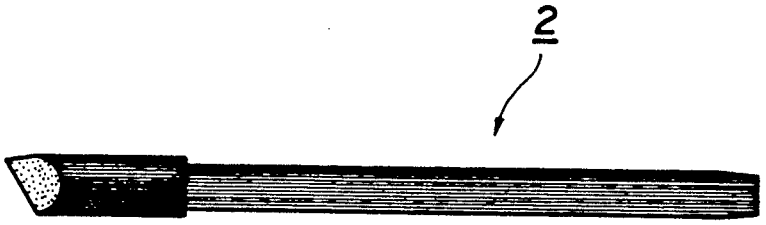

In FIGS. 6 and 17, the pen tip 2 is shown as being a fiber aggregate member, such as those frequently used in underline markers, a nail color (manicure, pedicure), or the like. The rear part of the fiber aggregate is provided with a reduced diameter for engagement with the step portion 6*a* of the front shaft. In FIG. 6, all the members other than the pen tip 2 are symmetric in the vertical direction. Besides the fiber aggregate member shown in the drawings, the pen tip 2 may be an ordinary fountain pen type pen tip, a brush of a cosmetic applicator, a porous foamed body pen tip for communication, or the like.

Figure 18:
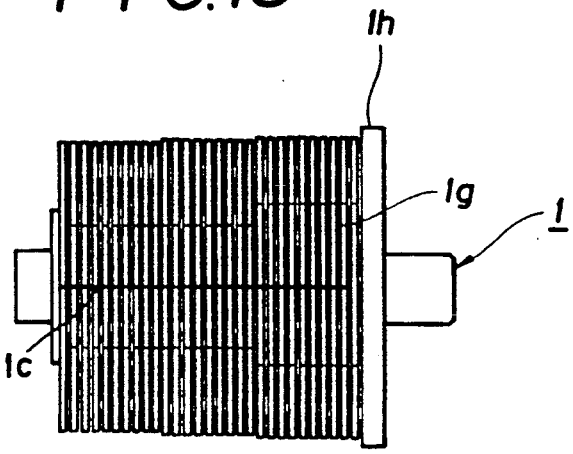
Figure 19:
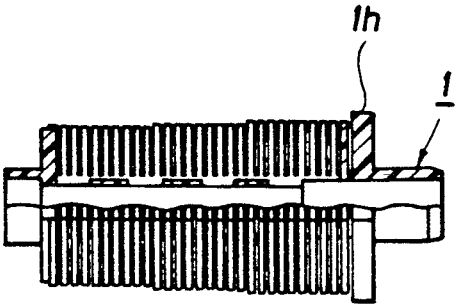

In FIGS. 18 and 19, an ink storage member 1 is shown which has the same general shape as that of the foregoing embodiment, except that the width of the recessed portion 1*g*, explained with reference to FIG. 5, is changed locally and a flange 1*h* is provided.

Figure 20:
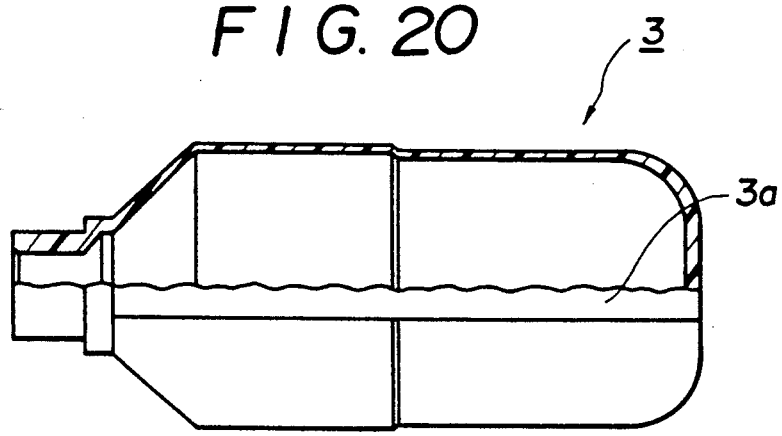
Figure 22:
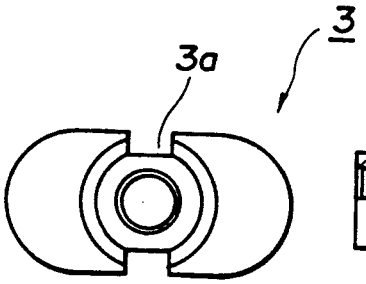
Figure 21:
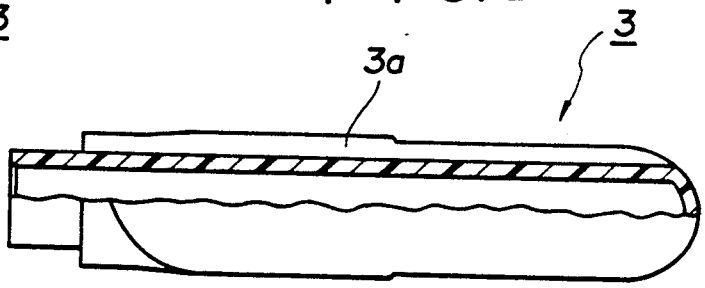
Figure 23:
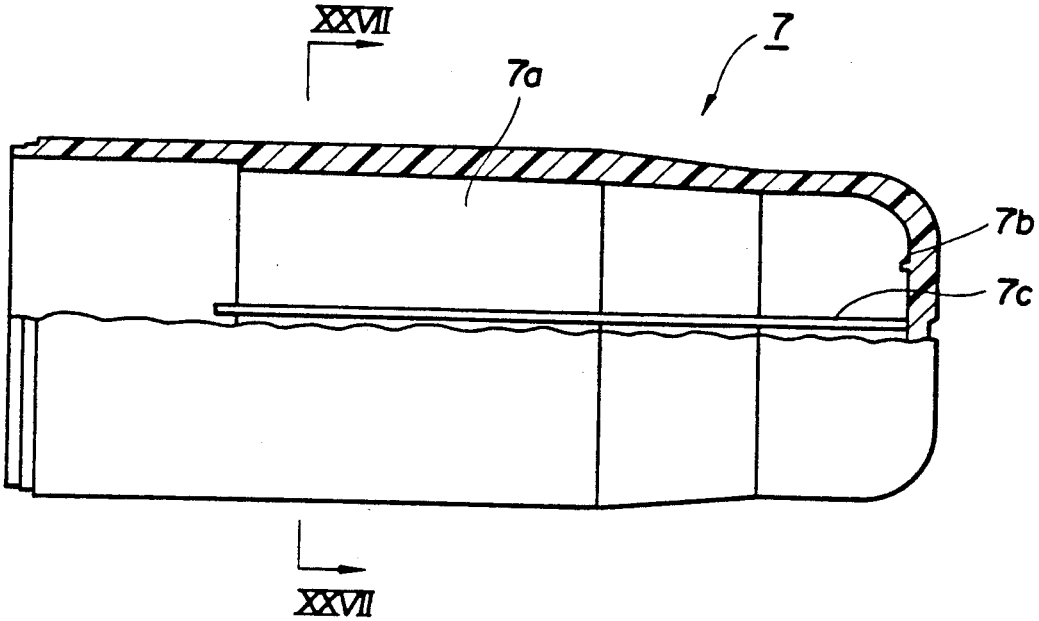
Figure 24:
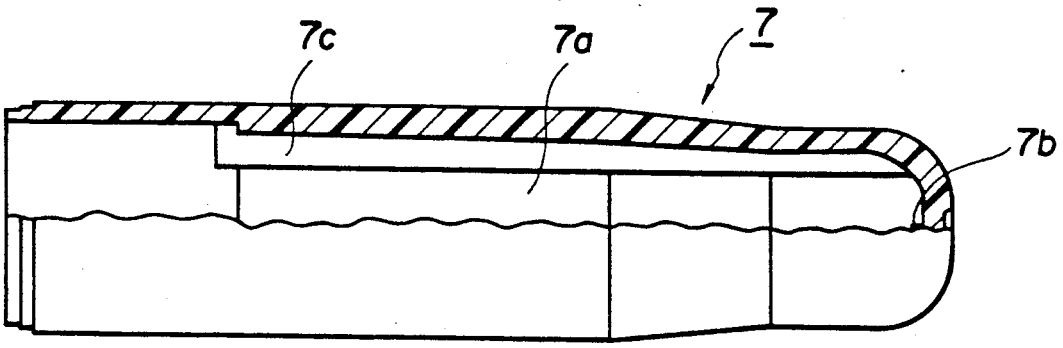
Figure 25:
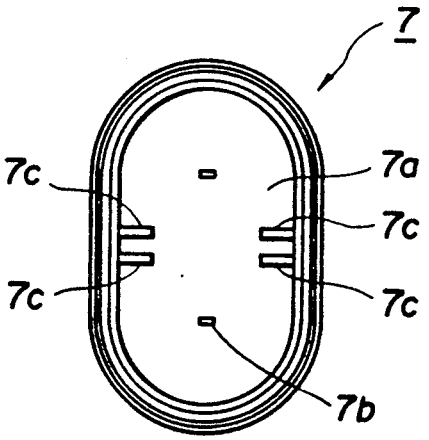
Figure 26:
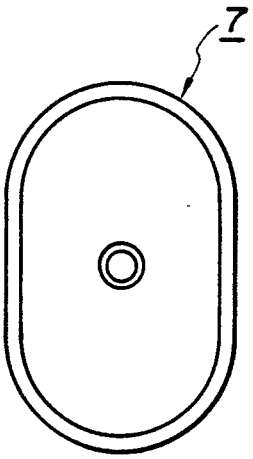
Figure 27:
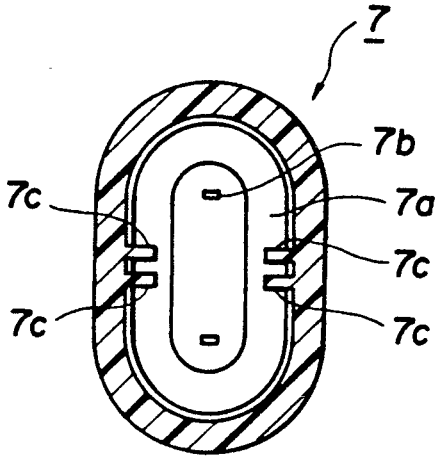

In FIGS. 20 to 22, an ink tank 3 is shown which is formed by blow molding of a synthetic resin and has a generally flat cross-sectional shape.

It is a rear shaft 7 shown in FIGS. 23 to 27 that stores the ink tank 3 and the rear part of the ink storage member 1 described above. This rear shaft 7 is also molded by injection molding of a synthetic resin. The rear shaft 7 shown in the drawings is fixed by ultrasonic fusion at the front shaft 6 and the flange 6*e*. A shaft which is molded integrally as a whole can of course be molded but if the shaft consists of two members, i.e. the front shaft 6 and the rear shaft 7 as in this embodiment, the assembly becomes much easier. In other words, the writing instrument main body is assembled by first assembling integrally the ink storage member 1 and the ink tank 3, then inserting this assembly into the rear shaft 7, mounting the front shaft 6 with the rear shaft 7, effecting ultrasonic fusion to attach the front 6 and rear 7 shafts, and inserting the pen tip 2 from ahead of the front shaft 6. The product shown in FIG. 6 can be obtained by fitting the pressed-together combination of the crown 4 and the cap 5 onto this main body. Here, ink may be stored in advance in the ink tank 3 or may be charged, after ultrasonic fusion, by a syringe or the like before the pen tip 2 is fitted into the front shaft 6. If the ink storage member 1 and the ink tank 3 are assembled integrally in advance, the assembly work can be improved, particularly when the shaft body is composed of a plurality of members such as the front shaft 6 and the rear shaft 7 as described above.

A small projection *7b* for limiting retreat of the ink tank 3 is disposed inside an inner hole *7a* of the rear shaft 7 shown in FIG. 6 in contact with the ink tank 3. The advance of the ink storage member 1 is limited by the small projection *6d* of the front shaft 6 while the retreat of the ink tank 3 is limited by the small projection *7b* of the rear shaft 7. These small projections come into contact with the ink storage member 1 and with the ink tank 3 and provide the side-effect that small variance of the molding dimension can be absorbed because of the resilience of the synthetic resin material.

Furthermore, flatness of the ink storage member 1 and the ink tank 3 (that is, the odd-shaped section) is utilized. The assembly of the ink storage member 1 and the ink tank 3 is accomplished by press-fitting and this fitting portion has a round cross-section so that they can rotate relative to each other and be liquid-tight at the press-fitting portion. According to this arrangement, the ink storage member 1 and the ink tank 3 can be stored with their cross-sectional shapes misaligned relative to one another.

A projection *7c* and a recess *3a* that extend in the longitudinal direction are formed on the inner wall of the inner hold *7a* of the rear shaft and on the outer surface of the ink tank 3, respectively, and they fit or idly fit with each other to function together as a guide when the ink tank 3 is stored in the rear shaft. This projection *7c* is designed so that its tip does not come into contact with the rear end of the ink storage member 1, but it may be designed so that the tip of projection *7c* does come into positive contact with the latter, if necessary. In such a case, if the ink tank 3 is attached to the ink storage member 1 with sufficient force, the ink storage member 1 can be stored inside the rear shaft 7 by sole means of its fit with the ink tank 3. The small projection *7b* of the rear shaft 7 may be formed as a stopper for preventing the ink tank 3 from becoming detached from the ink storage member 1.

When the ink storage member is fully provided with the above features, and is assembled in a writing instrument, the resulting writing instrument is of a high quality. In the embodiment shown in the drawing, the flange *1h* is formed on the ink storage member. This flange prevents the rearward movement of deposited ink even when ink is deposited outside the ink storage member 1 due to any impact applied to the writing instrument main body caused by, for example, the writing instrument being dropped. Moreover, the air exchange groove *1f* exists even at the flange *1h*, but the presence and movement of ink such as described above do not exist on the inner wall near the air exchange groove *1f*. Moreover, the air exchange groove *1f* communicates the inner space with the outside of the ink tank 3 and with the front portion. In other words, though it cuts off the movement of ink, the air exchange groove *1f* does not cut off the movement of air. Accordingly, the movement of air reduces the pressure change caused by fitting the cap 5, and lets the ink storage member 1 effectively perform its functions.

Besides the modified embodiment described above, various other modifications may be possible. For example, the front shaft 6 and the rear shaft 7 can be coupled by meshing engagement. The ink storage member 1 itself can be applied to those writing instruments which do not use a separate ink tank but rather utilize the rear inner space of the shaft as the ink tank. Though two ink grooves are shown formed as the ink grooves *1c*, three or more grooves *1c*, which are formed evenly about the cross-section, can be formed by injecting molding by increasing the number of moving directions of the split molds from two. The ink storage member may be of a type which does not have the through-hole *1a*, and a processing for improving wettability with ink can also be applied. Furthermore, transparent portion or portions may be provided to the ink tank 3 and at the rear part of the rear shaft 7 so that the existence of ink can be confirmed by viewing the ink tank.

As described above, the present invention can provide an ink storage member which is capable of excellent performance, and a writing instrument using such an ink storage member. As a specific example of an ink storage member which is capable of storing a large quantity of ink and temporarily storing ink, an experiment was carried out by storing 5 cc of ink in the ink tank 3 in the structure of the embodiment shown in FIG. 6 and subjecting the structure to five cycles of cooling and heating between 10°-50° C. This example results in absolutely no ink leakage or the like.

Although some preferred embodiments of the present invention has been described, the present invention is not particularly limited thereto but can be changed or modified in various manners without departing from the spirit and scope as set forth in the appended claims.

We claim:

1. A temporary ink storage member for temporarily storing ink in response to pressure changes in an ink tank, including:

an elongated core portion having a through-hole formed along a length thereof;

a reduced thickness portion extending radially outwardly from said core portion and having a longitudinal section of comb-tooth shape with a plurality of teeth separated by gaps, and a cross section with opposing long portions and opposing short portions shorter than said long portions;

a slit-shaped ink groove formed longitudinally of said elongated core portion and in communication with said through-hole, said slit-shaped ink groove being formed in one of said opposing short portions; and wherein a temporary ink storage portion is defined by said gaps, is in communication with said slit-shaped ink groove, and has deep portions defined by ones of said gaps in said short portions and shallow portions defined by ones of said gaps in said long portions, said temporary ink storage portion being disposed about substantially an entire periphery of said core portion as viewed in cross section.

2. A temporary ink storage member as recited in claim 1, wherein air exchange grooves are formed on opposing sides of said reduced thickness portion.

3. A temporary ink storage member as recited in claim 1, wherein said reduced thickness portion comprises a plurality of spaced apart thin wall portions extending radially outwardly from said core portion.

4. A temporary ink storage member as recited in claim 1, wherein said long portions are devoid of ink grooves communicating between said temporary ink storage portion and said through-hole.

5. A writing instrument comprising:

a tubular shaft having a writing end;

an ink tank in a rear end of said tubular shaft opposite said writing end; and a temporary ink storage member mounted in said tubular shaft between said writing end and said ink tank for temporarily storing ink in response to pressure changes in said ink tank, said temporary ink storage member including an elongated core portion having a through-hole formed along a length thereof, a reduced thickness portion extending radially outwardly from said core portion and having a longitudinal section of comb-tooth shape with a plurality of teeth separated by gaps, and a cross section with opposing long portions and opposing short portions shorter than said long portions, a slit-shaped ink groove formed longitudinally of said elongated core portion and in communication with said through-hole, said slit-shaped ink groove being formed in one of said opposing short portions, and wherein a temporary ink storage portion is defined by said gaps, is in communication with said slit-shaped ink groove, and has deep portions defined by ones of said gaps in said short portions and shallow portions defined by ones of said gaps in said long portions, said temporary ink storage portion being disposed about substantially an entire periphery of said core portion as viewed in cross section.

6. A writing instrument as recited in claim 5, wherein air exchange grooves are formed on opposing sides of said reduced thickness portion.

7. A writing instrument as recited in claim 5, wherein said temporary ink storage member further includes a flange extending outwardly from said core portion at a position rearward of said reduced thickness portion and in contact with an inner surface of said tubular shaft; and grooves are formed in said flange in alignment with said air exchange grooves and are sized such that air, but not ink, can flow therethrough.

8. A writing instrument as recited in claim 5, wherein said reduced thickness portion comprises a plurality of spaced apart thin wall portions extending radially outwardly from said core portion.

9. A writing instrument as recited in claim 5, wherein said long portions are devoid of ink grooves communicating between said temporary ink storage portion and said through-hole.

10. A writing instrument as recited in claim 5, further comprising a writing nib mounted to aid tubular shaft at said writing end.

11. A writing instrument as recited in claim 5, wherein said tubular shaft, said ink tank, and said temporary ink storage member are formed of synthetic resin; and means are provided for limiting movement of said temporary ink storage member toward said writing end of said tubular shaft, and for limiting movement of said temporary ink storage member toward said rear end of said tubular shaft.

12. A writing instrument as recited in claim 11, wherein said tubular shaft is formed of a front shaft and a rear shaft, said front shaft and said rear shaft being discrete elements; and said limiting means comprises a projection mounted in said front shaft, and a projection mounted in said rear shaft.

13. A writing instrument as recited in claim 12, wherein said tubular shaft has a cross section which is approximately complementary with said cross section of said reduced thickness portion of said temporary ink storage member; and said ink tank has a cross section which is approximately complementary with said cross section of said tubular shaft.

14. A writing instrument as recited in claim 13, wherein said temporary ink storage member is rotatably mounted to said ink tank in a liquid-tight manner.

15. A writing instrument as recited in claim 14, wherein said tubular shaft has an elongated projection extending longitudinally in a rear end thereof; and said ink tank has a longitudinally extending recess formed in an outer wall thereof for receipt of said elongated projection.

16. A writing instrument as recited in claim 15, wherein a forwardmost end of said elongated projection contacts a rearward end of said temporary ink storage member.

17. A writing instrument as recited in claim 1, wherein said tubular shaft has a cross section which is approximately complementary with said cross section of said reduced thickness portion of said temporary ink storage member; and said ink tank has a cross section which is approximately complementary with said cross section of said tubular shaft.

18. A writing instrument as recited in claim 17, wherein said temporary ink storage member is rotatably mounted to said ink tank in a liquid-tank manner.

19. A writing instrument as recited in claim 18, wherein said tubular shaft has an elongated projection extending longitudinally in a rear end thereof; and said ink tank has a longitudinally extending recess formed in an outer wall thereof for receipt of said elongated projection.

* * * * *